US006179928B1

(12) United States Patent
Carlton

(10) Patent No.: US 6,179,928 B1
(45) Date of Patent: Jan. 30, 2001

(54) DISPOSABLE TOILET DRAIN UNCLOGGER

(76) Inventor: Robert H. Carlton, 645 Mulberry St., Williamson, WV (US) 25661

( * ) Notice: Under 35 U.S.C. 154(b), the term of this patent shall be extended for 0 days.

(21) Appl. No.: 09/327,394

(22) Filed: Jun. 7, 1999

Related U.S. Application Data

(60) Provisional application No. 60/088,387, filed on Jun. 8, 1998.

(51) Int. Cl.[7] ..... B08B 9/04; B08B 9/043

(52) U.S. Cl. ..... 134/6; 15/104.31; 15/104.16

(58) Field of Search ..... 15/104.03, 104.05, 15/104.15, 104.16, 104.31; 134/6; 366/129, 325.6, 343

(56) References Cited

U.S. PATENT DOCUMENTS

| | | | | |
|---|---|---|---|---|
| D. 302,638 | * | 8/1989 | Hiscott et al. | D7/103 |
| 458,090 | | 8/1891 | Zimmerman . | |
| 543,791 | * | 7/1895 | Wood | 15/104.16 |
| 714,907 | * | 12/1902 | Holder | 15/141.1 |
| 726,025 | * | 4/1903 | Cady | 15/141.1 |
| 963,965 | | 7/1910 | Weber . | |
| 986,462 | | 3/1911 | Holdaway . | |
| 1,088,794 | * | 3/1914 | Pierce | 15/104.16 |
| 1,261,444 | | 4/1918 | Schied . | |
| 1,579,382 | * | 4/1926 | Mitchell | 15/141.1 |
| 2,567,923 | | 9/1951 | Burke | 15/104.3 |
| 3,171,149 | * | 3/1965 | Ciaccio | 15/104.31 |
| 3,330,533 | | 7/1967 | Blume | 254/134.3 |
| 3,480,021 | | 11/1969 | Ewald | 134/24 |
| 4,256,510 | * | 3/1981 | Thompson et al. | 134/6 |
| 4,735,510 | * | 4/1988 | Barbour et al. | 366/343 |
| 4,794,739 | | 1/1989 | Ivanditto | 51/262 |

* cited by examiner

*Primary Examiner*—Terrence R. Till
(74) *Attorney, Agent, or Firm*—Steptoe & Johnson

(57) ABSTRACT

An apparatus having a handle and a plurality of elongated loops connected to the handle provides a means for unclogging a toilet or sink drain of an impediment. In the preferred embodiment, the apparatus is long and slender in profile to fit within a toilet or sink drain. Furthermore, the apparatus is preferably made of a flexible and firm plastic, thereby providing the means for the apparatus to bend and mold when pushed through a toilet drain. Also in the preferred embodiment, the apparatus is disposable such that a user does not have to wash or store the apparatus after its use.

14 Claims, 2 Drawing Sheets

DISPOSABLE TOILET DRAIN UNCLOGGER

CROSS REFERENCE TO RELATED APPLICATIONS

This application claims the benefit of application Ser. No. 60/088,387, filed Jun. 8, 1998.

BACKGROUND OF THE INVENTION

1. Field of the Invention

This invention relates to apparatuses for unclogging toilet drains, and specifically, to disposable apparatuses for inserting into a clogged toilet drain and removing an impediment therefrom.

2. Related Art

At some point in everyone's life, a person experiences the displeasure of encountering a clogged toilet drain wherein an impediment blocks the toilet drain such that the water of a toilet bowl does not drain properly. Under such circumstances, a person typically reaches for a plunger to unclog the toilet drain.

There are many disadvantages associated with using a conventional plunger. The principal disadvantage is that a plunger attempts to create a vacuum within the toilet drain where a pumping action with the plunger is used to create a suction. The impediment in the toilet drain is pushed and pulled via this suction until it is loosened and eventually flushed away. In many cases, the impediment is not removed in a timely manner due to the bulky size or dense nature of the impediment. Therefore, what is needed is an apparatus for unclogging a toilet drain that can actually break up the impediment making it easier to remove from the toilet drain.

Another disadvantage associated with using a plunger is that the plunger typically becomes soiled from being used in a clogged toilet. Therefore, there is a need for a disposable toilet drain unclogger wherein the apparatus can be easily disposed of after use.

In addition to a conventional plunger, there are several apparatus available to assist a person with unclogging a toilet drain. However, none of these available apparatuses are designed for household use wherein the apparatus is easy to use, effective, and disposable.

In U.S. Pat. No. 963,965 to Weber, a pipe cleaner is disclosed comprising a gripping member wherein once an impediment is contacted within a toilet drain, the gripping member is engaged such that the pipe cleaner grabs the impediment so that it can be pulled from the toilet drain. Due to the complicated mechanical nature of this apparatus, the disclosed pipe cleaner requires a certain amount of skill and proficiency in inserting the pipe cleaner and working the gripping member. The pipe cleaner may also not be able to grab certain impediments. In addition, the fingers of the pipe cleaner may present a danger to small children who come in contact therewith.

In U.S. Pat. No. 986,462 to Holdaway, a sewer cleaner is disclosed comprising a combination of extending ribs and a split circular knife wherein the apparatus is pulled through a sewer to cut roots or other vegetation growing within the sewer. It is readily apparent that this apparatus is not suitable for conventional household use as used in connection with a clogged toilet drain.

In U.S. Pat. No. 1,261,444 to Schied, a tool for removing obstructions from plumbing passageways is disclosed which is intended for conventional household use. The disclosed tool comprises a grappling member having a plurality of twisted pronged tines attached to the end of an elongated shaft and crank handle. In use, the tool is inserted into a clogged toilet drain until an impediment is contacted. If the impediment cannot be pushed through the toilet drain, the user turns the crank thereby turning the grappling member until the tines embed the impediment such that it can be pulled from the toilet drain. Despite its claimed effectiveness, this tool has several disadvantages. First, the tool is dangerous to have laying around the house because of the twisted prong tines. A person, especially a small child, may accidently get impaled or cut on the tines. Second, if an impediment must be pulled from the toilet drain, the user will have to dispose of it.

In U.S. Pat. No. 2,567,923 to Burke, a pip-cleaning swab is disclosed that comprises an elongated shaft with a bent plate attached to one end of the elongated shaft and having a textile sleeve with tentacles covering the bent plate. This swab does not provide the needed flexibility for passing through a curved toilet drain found in conventional households due to the rigid nature of the bent plate. Furthermore, the bent plate does not provide any means for breaking up an impediment of a clogged toilet drain, but rather, can only push an object forward out of the toilet drain. The tentacles are disclosed as being able to wrap around an impediment in order to pull it out of the toilet drain; however, given the fact that the impediment fully closes off the toilet drain, it would be extremely difficult if not impossible for the tentacles to sufficiently surround and grasp the impediment for its removal.

In U.S. Pat. No. 3,330,533 to Blume, a twisted hook terminal for roding ducts is disclosed for running a cable, or other line, e.g. a telephone line, through a conduit. Specifically, this patent discloses a fish tape and a pulling device, wherein the cable is attached to the fish tape. The fish tape is grabbed by a pulling device and pulled through a conduit, thereby the desired cable or other line is pulled through the conduit. Therefore, this device is not intended, nor capable of, assisting a user in eliminating an impediment from a clogged toilet drain. The fish tape comprises a plurality of looped wires that are bent upon themselves and connected to an anchor. The looped wires must be sufficiently strong so as to maintain their shape and position relative to each other. If the looped wires collapsed or moved out of position within the conduit, then the pulling device would be unable to engage the looped wires, thereby becoming unable to pull a line through the conduit. Furthermore, the fish tape as disclosed is unable, as well as not intended, to remove clogs or other impediments from the conduit. In fact, this apparatus teaches away from using this apparatus for removing impediments because this apparatus would not work if any impediment is located in a conduit through which the fish tape and pulling device are to pass.

Therefore, there is a need for a disposable toilet drain unclogger that is capable of pushing as well as pulling and/or breaking up an impediment from a clogged toilet drain.

SUMMARY OF THE INVENTION

The present invention solves the problems associated with removing impediments from a clogged toilet drain by providing an apparatus comprised of a handle and a plurality of flexible and bendable elongated loops that are attached to the handle. In the preferred embodiment the apparatus is of such a width as to easily fit within a conventional toilet drain and of such a length as to protect the user from contacting the water of the toilet while removing the impediment.

There are many advantages associated with the apparatus of the present invention. First, the elongated loops of the present invention are very long in relation to similar apparatuses. Therefore, the apparatus continues to break up an impediment found in a clogged toilet drain throughout the entire length of the toilet drain as the user moves the apparatus back and forth.

In addition, the apparatus is very simple and easy to use. A person does not have to deal with any complicated mechanical devices or methods of operation. In use, a person merely has to insert the apparatus until an impediment is contacted, then push, pull and twist the apparatus until the impediment is dislodged and/or broken up, and finally flush the impediment down the toilet drain.

The apparatus of the present invention is also very economical. Due to its simple design and structure, the apparatus is very inexpensive and intended to be disposable. After use, a user does not have to clean the apparatus or worry about storing the apparatus—the user can simply throw the apparatus away.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE PREFERRED EMBODIMENTS

Figure 1:
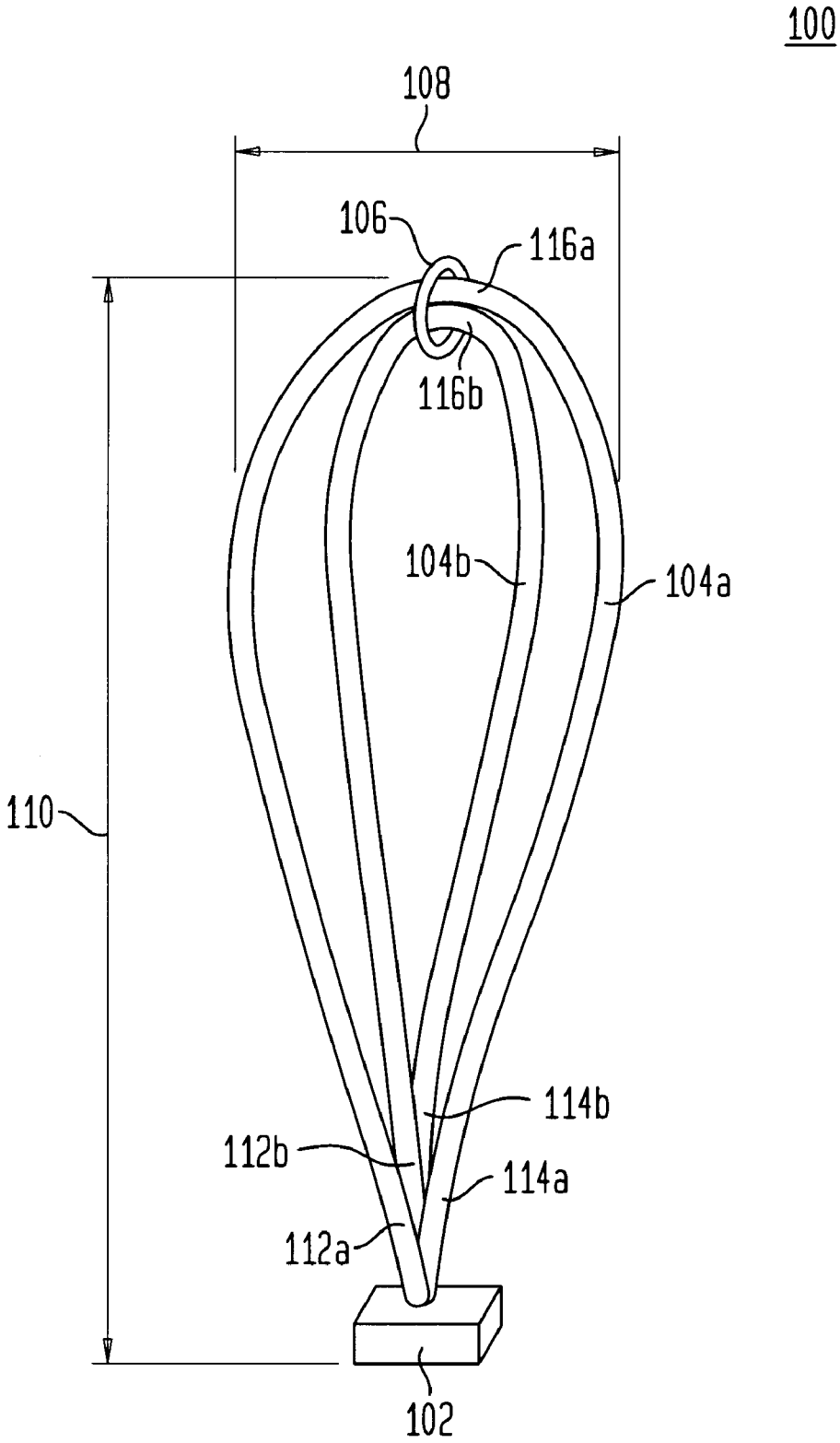
FIG. 1 is a perspective view of the preferred embodiment of an apparatus of the present invention.

FIG. 1 is a perspective view of the preferred embodiment of an apparatus 100 of the present invention for unclogging a toilet drain. In the preferred embodiment, the apparatus 100 comprises a handle 102 and a plurality of elongated loops 104*a,b*. For convenience purpose only, the apparatus 100 is shown with two elongated loops 104*a,b*. It would be readily apparent to one of ordinary skill in the relevant art(s) to design and manufacture an apparatus 100 having more than two elongated loops 104*a,b*. Further, the elongated loops 104*a,b* maybe of any shape, e.g. round tubing, as shown, or flat straps. Each elongated loop 104*a,b* has a top 116*a,b*, a first end 112*a,b* and a second end 114*a,b*, wherein the first ends 112*a,b* and second ends 114*a,b* are securely connected to the handle 102. The elongated loops 104*a,b* are attached directly to the handle 102 in order to provide the user with the extended means of breaking up an impediment the entire length of the apparatus 100 as the apparatus 100 is in use.

The apparatus 100 also comprises an optional means for connecting 106 the tops 116*a,b* of the plurality of loops 104*a,b*. In the preferred embodiment, the means for connecting 106 is a ring connector wherein the elongated loops 104*a,b* pass through the ring connector. The use of a ring connector is for convenience purpose only. It would be readily apparent to one of ordinary skill in the relevant art(s) to use a different means for connecting the tops 116*a,b* of the elongated loops 104*a,b*, e.g., a clip, tab, pin, fastener, and the like. The means for connecting 106 secures the tops 116*a,b* of the elongated loops 104*a,b* from moving out of position.

In the preferred embodiment, the apparatus 100 is made of a flexible, but firm plastic. This provides the means for the apparatus 100 to bend and mold within a toilet drain to any needed shape in order to move through the toilet drain and eliminate an impediment therein. Furthermore, the use of plastic will provide the apparatus 100 with the needed flexibility and resilience in pushing and pulling the impediment through the toilet drain. If the apparatus 100 was made of a material that is too soft and flimsy, the user would not be able to provide enough force with which to move an impediment. And if the apparatus 100 was made of a material that was too strong and stiff, the user would not be able to maneuver the apparatus 100 through the toilet drain. The preferred embodiment is described in terms of plastic for convenience purpose only. It would be readily apparent to one of ordinary skill in the relevant art to design and manufacture an apparatus 100 of the present invention using a comparable material that provides the same functionality in terms of flexibility and firmness. Furthermore, sufficient detail has been provided that would enable any one of ordinary skill in the relevant art(s) to manufacture an apparatus 100 of the present invention.

In the preferred embodiment, the apparatus 100 is intended for unclogging a toilet drain. Therefore, the apparatus 100 is approximately three (3) feet in length 110 and the elongated loops 104*a,b* are approximately four to six inches in width 108. In an alternative embodiment, the apparatus 100 is adapted for use in a sink drain, wherein the elongated loops 104*a,b* are approximately two inches in width 108. The preferred embodiment is described in these dimensions for convenience purpose only. It would be readily apparent to one of ordinary skill in the relevant art to design and manufacture an apparatus 100 of the present invention using comparable dimensions.

In operation, a user uses the apparatus 100 whenever there is an impediment in a toilet drain causing the toilet to back up or not flush. The user, holding onto the handle 102, inserts the tops 116*a,b* of the elongated loops 106 into the toilet drain until the tops 116*a,b* contact the impediment. Once contact is established, the user pushes, pulls, and/or twists the apparatus 100 to move, breakup, or otherwise dislodge, the impediment from the toilet drain. Once the impediment has been eliminated, the user is free to flush the toilet, thereby completely clearing the toilet drain of any remaining impediment. Furthermore, the user simply throws away the apparatus 100 without needing to clean it up or store it for another use.

Figure 2:
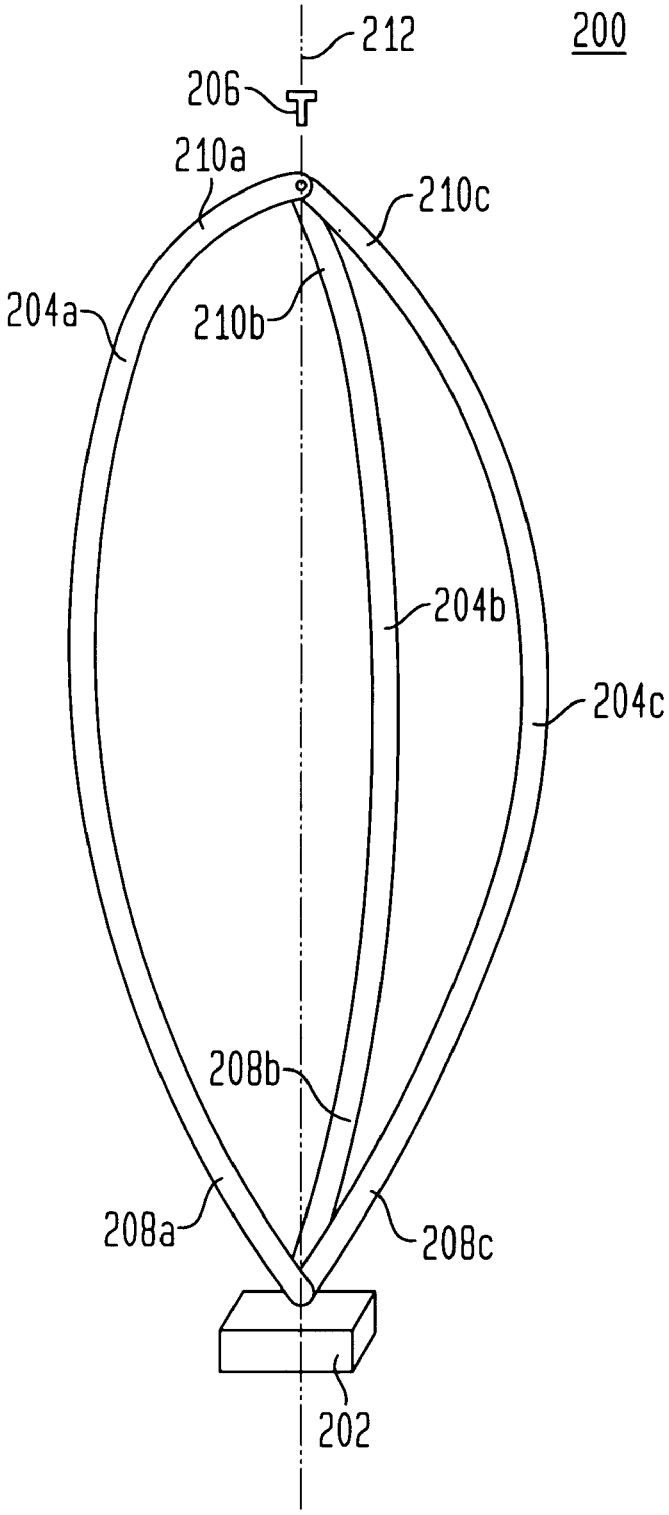
FIG. 2 is a perspective view of an alternative embodiment of the apparatus of the present invention.

FIG. 2 is a perspective view of an alternative embodiment of the apparatus 200 of the present invention. Although structurally similar to the preferred embodiment of the apparatus 100, the alternative apparatus 200 comprises a handle 202 and a plurality of elongated arms 204*a–c*. Each elongated arm 204*a–c* has a first end 208*a–c* and a second end 210*a–c*, wherein the first ends 208*a–c* are securely connected to the handle 202. The second ends 210*a–c* of the elongated arms 204*a–c* are also securely attached together with a clip, pin, fastener, or other means for connecting 206. The connecting 206 of the second ends 210*a–c* of the elongated arms 204*a–c* causes the elongated arms 204*a–c* to bow outward from a center axis 212. Furthermore, when pressure is exerted on the second ends 210*a–c*, such as when pushing an impediment through a toilet drain, the elongated arms 204*a–c* will bend further outward from the center axis 212.

Conclusion

While various embodiments of the present invention have been described above, it should be understood that they have been presented by the way of example only, and not limitation. It will be understood by those skilled in the art that various changes in form and details may be made therein without departing from the spirit and scope of the invention as defined in the specification and the appended claims. Thus, the breadth and scope of the present invention should not be limited by any of the above-described exemplary embodiments, but should be defined in accordance with the specification and any equivalents.

What is claimed is:

1. An apparatus for unclogging a drain, comprising:

a handle;

a plurality of elongated loops, each said loop having a loop width, a top, a first end and a second end, the first end and the second end are securely and permanently connected to said handle such that said elongated loops form a generally 3-dimensional conical shape; and a means for connecting the top of each said elongated loop.

2. The apparatus for unclogging a drain according to claim 1, wherein said means for connecting is a ring connector.

3. The apparatus for unclogging a drain according to claim 1, wherein the length of the apparatus is approximately three feet long.

4. The apparatus for unclogging a drain according to claim 3, wherein the loop width is about four to six inches.

5. The apparatus for unclogging a drain according to claim 4, wherein said elongated loops are manufactured of a flexible and firm plastic.

6. An apparatus for unclogging a drain, comprising:

a handle; and a plurality of elongated loops, each said loop having a loop width about two inches, a top, a first end and a second end, the first end and the second end are securely and permanently connected to said handle;

wherein the length of the apparatus is approximately three feet long.

7. The apparatus for unclogging a drain according to claim 6, wherein said elongated loops are manufactured of a flexible and firm plastic.

8. An apparatus for unclogging a drain, comprising:

a handle;

a plurality of elongated arms, each said elongated arm having a first end and a second end, the first ends being securely and permanently connected to said handle; and a means for connecting together the second ends of said elongated arms, wherein when pressure is exerted on the second ends of said elongated arms, said elongated arms bend outward from a center axis and form a generally 3-dimensional conical shape;

wherein said means for connecting together the second ends of said elongated arms is a pin.

9. The apparatus for unclogging a drain according to claim 8, wherein said elongated loops are manufactured of a flexible and firm plastic.

10. The apparatus for unclogging a drain according to claim 8, wherein the length of the apparatus is approximately three feet long.

11. A method for unclogging a drain with an apparatus having a handle and a plurality of elongated loops, each said elongated loop having a loop width, a top, a first end and a second end, the first end and the second end are securely and permanently connected to said handle, comprising the steps of:

(a) inserting the apparatus into the clogged drain until the top of said elongated loops contact a impediment;

(b) pushing and twisting the apparatus against the impediment to loosen the impediment;

(c) pulling the apparatus wherein the impediment is pulled from its location in the drain;

(d) repeating steps (b) and (c) as needed to completely dislodge the impediment; and (e) removing the apparatus from the drain.

12. The method for unclogging a drain according to claim 11, further comprising the step of:

(f) disposing of the apparatus.

13. An apparatus for unclogging a drain, comprising:

a handle;

a plurality of elongated arms, each said elongated arm having a first end and a second end, the first end being securely and permanently connected to said handle;

a means for connecting together the second ends of said elongated arms, wherein when pressure is exerted on the second ends of said elongated arms, said elongated arms bend outward from a center axis and form a generally 3-dimensional conical shape, wherein the length of the apparatus is approximately three feet long.

14. The apparatus for unclogging a drain according to claim 13, wherein said handle and said plurality of elongated arms are manufactured of a flexible and firm plastic.

* * * * *